US006198212B1

(12) United States Patent
Kim et al.

(10) Patent No.: US 6,198,212 B1
(45) Date of Patent: Mar. 6, 2001

(54) DISPLAY SYSTEM HAVING ANION GENERATION MEANS

(75) Inventors: Hun-soo Kim, Seoul; Eun-keu Oh, Suwon; Sang-wook Wu; Jeong-hee Kim, both of Sungnam; Ji-na Namgoong; Kyoung-mi Cho, both of Suwon, all of (KR)

(73) Assignee: Samsung Display Devices Co., Ltd., Kyungki-do (KR)

( * ) Notice: Subject to any disclaimer, the term of this patent is extended or adjusted under 35 U.S.C. 154(b) by 0 days.

(21) Appl. No.: 09/326,642

(22) Filed: Jun. 7, 1999

(30) Foreign Application Priority Data

Jun. 29, 1998 (KR) ..... 98-24990
Nov. 19, 1998 (KR) ..... 98-49769
Nov. 24, 1998 (KR) ..... 98-50478

(51) Int. Cl.[7] ..... H01J 29/06
(52) U.S. Cl. ..... 313/479
(58) Field of Search ..... 313/355, 479, 313/402, 326, 313, 352, 239; 174/35 MS

(56) References Cited

U.S. PATENT DOCUMENTS 4,217,521 * 8/1980 Dietch et al. ..... 313/479
5,451,840 * 9/1995 Abe et al. ..... 313/479 X
5,574,619 11/1996 Jeong ..... 361/230
5,576,923 11/1996 Park ..... 361/213
5,998,920 * 12/1999 Kim ..... 313/479

FOREIGN PATENT DOCUMENTS 0 660 638 6/1995 (EP) .
2 295 929 6/1996 (GB) .
10-005025 1/1998 (JP) .
10-0229434 8/1998 (JP) .

* cited by examiner

*Primary Examiner*—Ashok Patel
(74) *Attorney, Agent, or Firm*—Leydig, Voit & Mayer, Ltd.

(57) ABSTRACT

A display system includes a cathode ray tube having a panel and a funnel which is coupled to the panel forming a seal and has an external graphite layer formed on the outer circumferential surface thereof; a case in which a space is formed to provide room for the cathode ray tube to be installed therein; and material for anion generation disposed at a predetermined position with respect to the cathode ray tube or the case. The anions generated from the material for anion generation is beneficial to a user of a display system. Also, a transferring portion is provided to control the transfer distance of anions to the user.

17 Claims, 5 Drawing Sheets

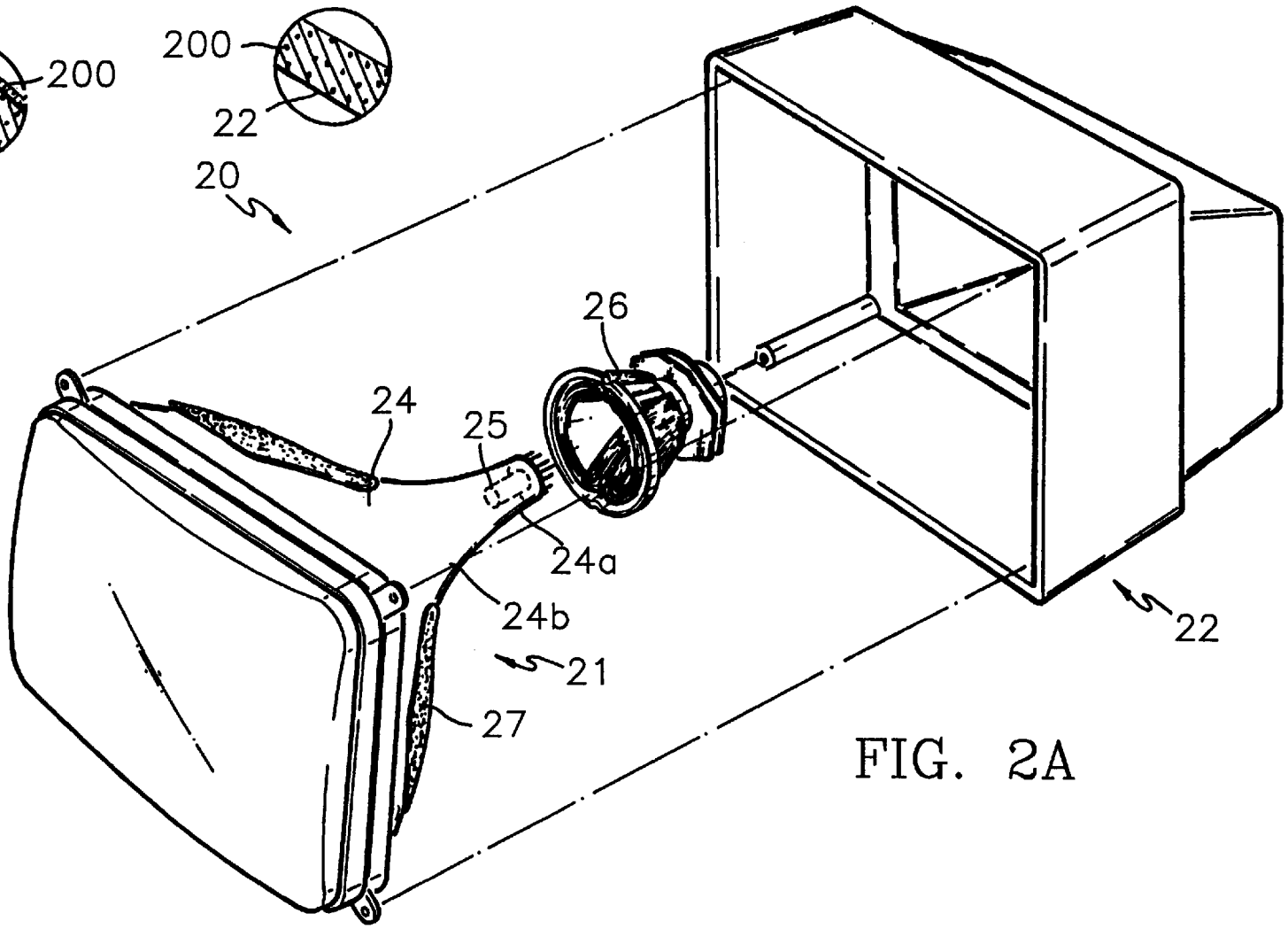
FIG. 2A
FIG. 2C
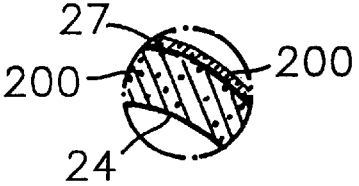
FIG. 2B

DISPLAY SYSTEM HAVING ANION GENERATION MEANS

BACKGROUND OF THE INVENTION

1. Field of the Invention

The present invention relates to a display apparatus, and more particularly, to a display system having an anion generation means.

2. Description of the Related Art

In general, it is well known that cations existing in the air are harmful to humans whereas anions are beneficial. When cations are absorbed into the human body, active oxygen in blood is not controlled, and the penetration ability of electrolytes such as sodium (Na) or potassium (K) and waste material is lowered so that detrimental matter is accumulated in the human body. Also, the exhaust gas or smoke fumes from vehicles and factories is charged into cations and causes symptoms of dizziness, nausea and feeling of uneasiness.

When anions are absorbed into the human body, cells of living tissues in blood are activated so that the metabolism of transport and exchange of electrolytes such as sodium or potassium and waste material through the cell membrane is improved. Thus, the natural curing ability is improved and the automatic nervous system is activated. The typical effects of anions are an increase of immunity, mental stability, improvement of physical functions, improved excretion of waste material and respiratory functions, and a decrease of fatigue, among others.

In our recent living environment, anions are decreasing while cations are increasing, which is due to an increase in waste gases from vehicles and deterioration of the living environment. For example, a display system such as a computer or TV generates cations in great quantities. Particularly, a display system in a completely closed space generates even more cations. The cations generated are not only harmful but also cause static electricity on the display system. For example, cations accumulated on the surface of a panel of a cathode ray tube display apparatus cause static electricity which makes the panel surface accumulate dust and dirt.

To reduce such effects due to cations, an anion generation apparatus which neutralizes a cation with an anion is additionally installed in a display system. As the anion generation apparatus, an apparatus using a corona discharge or arc discharge is used. Electrons generated by the corona discharge method or the arc discharge method are distributed into the air and thus ionize nearby air molecules, particularly oxygen molecules.

However, the above discharge methods have defects in that not only are oxygen molecules ionized but ozone and nitrogen oxides are generated which are harmful to humans. Since the ozone generated through chemical conversion of parts of oxygen molecules by the energy generated from corona discharge has a specific odor which gives an unpleasant feeling and further is harmful to humans, the amount of its production is restricted by law in some countries. Also, an additional space is required to install the anion generation apparatus of a discharge type in a display apparatus. Furthermore, the anion generation apparatus above has another harmful factors due to electromagnetic waves which are generated when power is applied.

Meanwhile, according to the conventional anion generation display system, the anions generated are not transferred to a user in a sufficient amount and further the transfer distance of anions cannot be controlled at a user's discretion. To extend the transfer distance of anions, the conventional system has used a fan which blows anions toward a user. However, such method has shortcomings in that it cannot properly transfer (blow) anions to a user disposed far from the display system. That is, the transfer distance of anions cannot be freely controlled.

SUMMARY OF THE INVENTION

To solve the above problem, it is an objective of the present invention to provide a display system having an improved anion generation means.

It is another objective of the present invention to provide a display system having an anion generation means in which the transfer distance of anions generated can be controlled.

Accordingly, to achieve the above objective, there is provided a display system which comprises: a cathode ray tube having a panel and a funnel which is coupled to the panel forming a seal and has an external graphite layer formed on the outer circumferential surface thereof; a case in which a space is formed to provide room for the cathode ray tube to be installed therein; and material for anion generation disposed at a predetermined position with respect to the cathode ray tube or the case.

It is preferred in the present invention that the material for anion generation is a layer coated to a predetermined thickness on the outer surface of the panel or funnel of the cathode ray tube, or the outer or inner surface of the case.

It is preferred in the present invention that the material for anion generation is mixed with the base material of the external graphite layer when the external graphite layer is manufactured.

It is preferred in the present invention that the material for anion generation is mixed with the base material of the case when the case is manufactured.

It is preferred in the present invention that the material for anion generation is mixed with surface material for preventing electrification which is coated on the surface of the panel.

It is preferred in the present invention that the display system further comprises: a transfer case having a lower side inlet through which the anions generated from the material for anion generation are input and a front side outlet through which the anions are emitted to the outside; and a first electromagnet installed at the opposite sides of the transfer case to form a predetermined magnetic field inside the transfer case.

It is preferred in the present invention that the voltage applied to the first electromagnet can be changed so as to change the intensity of the magnetic field formed inside the transfer case.

It is preferred in the present invention that the display system further comprises: a receiving case having an upper side opening corresponding to the bottom of the transfer case and a lower side opening corresponding to the surface of the funnel of the cathode ray tube; and a plurality of second electromagnets installed at both opposite sides of the receiving case parallel to each other.

It is preferred in the present invention that the voltages applied to the second electromagnets are set to be different according to the installation position of each of the second electromagnets at the receiving case such that the anions passing through the receiving case can proceed toward the transfer case.

It is preferred in the present invention that the material for anion generation includes: ceramic which includes at least one of tourmaline and radioactive substance, and an oxide, and their mixing weight ratio varies between 0.0001:99.9999 and 50:50; a dispersing agent; a binding agent; and a solvent.

It is preferred in the present invention that the amount of the ceramic included is 1–50 weight % with respect to the total amount of the composition.

It is preferred in the present invention that the oxide is at least one among oxides of a metal selected from the group consisting of silicon (Si), aluminum (Al), it. zirconium (Zr), lanthanum (La), magnesium (Mg), cesium (Cs), calcium (Ca), copper (Cu), zinc (Zn) and neodymium (Nd), or a composition thereof.

It is preferred in the present invention that the radioactive emission substance is a natural radioactive substance of at least one selected from the group consisting of thorium base, uranium base, neptunium base, and actinium base, synthetic radioactive substance, or a composition thereof.

It is preferred in the present invention that the tourmaline exhibits a hardness of 7–7.5 on Mohs scale and has specific gravity of 2.90–3.10 g/cm$^3$.

It is preferred in the present invention that the material for anion generation is coated in the form of paste, liquid, or slurry.

It is preferred in the present invention that said material for anion generation is charcoal.

It is preferred in the present invention that said charcoal includes carbon of 75–85% and mineral of 2–3% as ingredients.

BRIEF DESCRIPTION OF THE DRAWINGS

The above objectives and advantages of the present invention will become more apparent by describing in detail a preferred embodiment thereof with reference to the attached drawings in which:

FIG. 2A is an exploded perspective view illustrating a display system according to a second preferred embodiment of the present invention and FIGS. 2B and 2C are detailed view of the embodiment;

DETAILED DESCRIPTION OF THE INVENTION

Figures 1A, 1B, 1C:
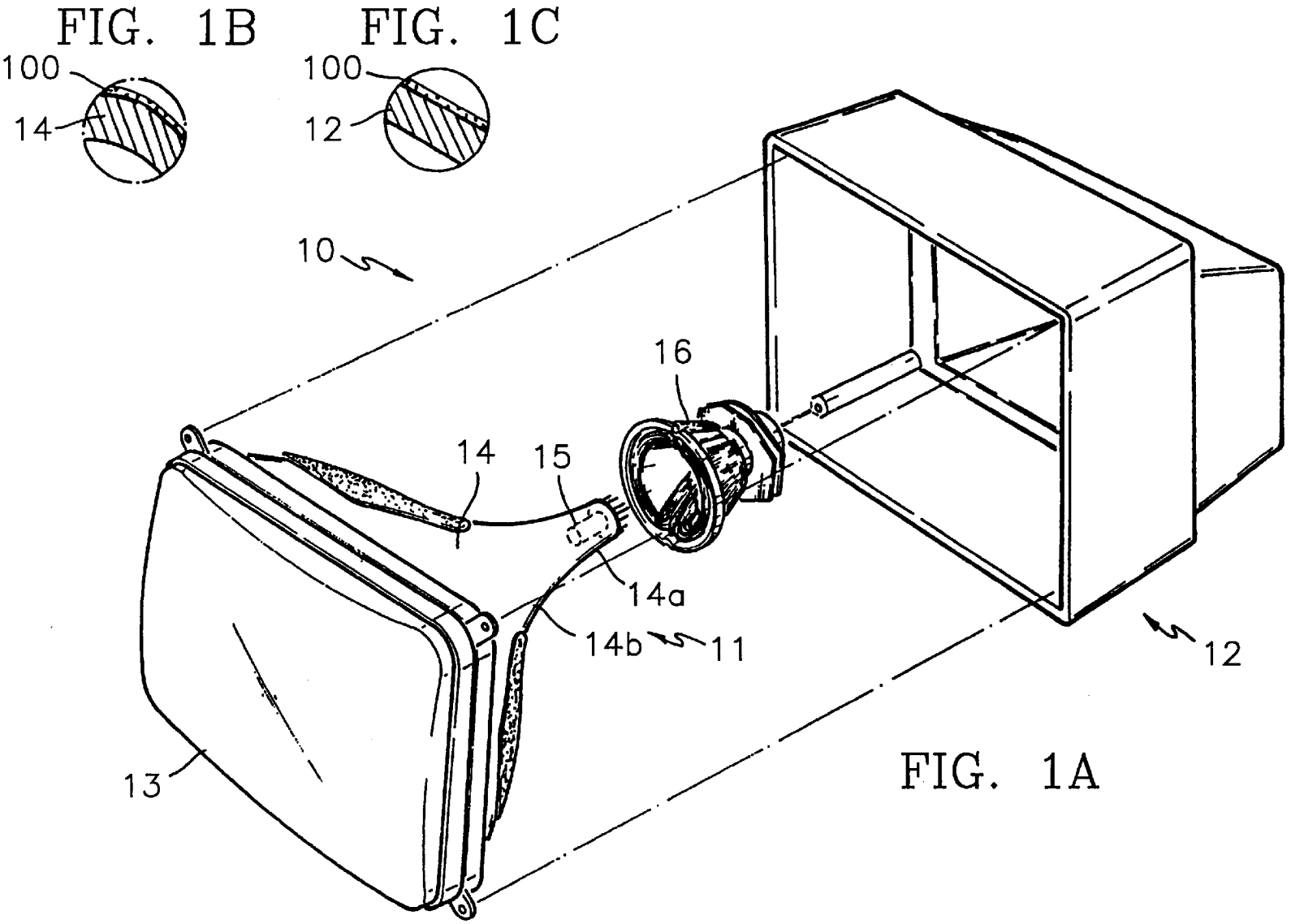
FIG. 1A is an exploded perspective view illustrating a display system according to a first preferred embodiment of the present invention and FIGS. 1B and 1C are detailed views of the embodiment.

FIG. 1A shows a display system 10 according to the first preferred embodiment of the present invention. Referring to the drawing, the display system 10 consists of a cathode ray tube 11 for forming an image and a case 12 in which the cathode ray tube 11 is installed. The cathode ray tube 11 includes a panel 13 and a funnel 14 which is coupled to the panel 13 forming a seal. An electron gun 15 is installed at a neck portion 14*a* of the funnel 14. A deflection yoke 16 for deflecting an electron beam emitted from the electron gun 15 is installed at a cone portion 14*b* of the funnel 14. The cathode ray tube 11 is installed in the case 12.

An anion generation apparatus according to the present invention is installed at a predetermined position of the display system 10. FIG. 1B shows the section of the funnel 14 and FIG. 1C shows the section of the case 12. Reference numeral 100 shown in FIGS. 1B and 1C indicates a coated layer for anion generation which constitutes the anion generation apparatus of the present invention. The coated layer for anion generation 100 may be a thin film of a predetermined thickness coating the outer surface of the cathode ray tube 11, i.e., the front surface of the panel 13 or the outer circumferential surface of the funnel 14, or the inner or outer surface of the case 12.

The coating for anion generation 100 can be formed of a material which can emit anions in a natural state. For example, the material for anion generation forming the coating for anion generation is a ceramic having silicon (Si), zirconium (Zr), cerium (Ce), lanthanum (La), magnesium (Mg), and calcium (Ca) as main ingredients. In another preferred embodiment, the material for anion generation is a composition in which $Al_2O_3$, $SiO_2$, ZrO, and $TiO_2$ are mixed with other materials in a predetermined ratio. In yet another preferred embodiment, the material is a composition which includes an ion neutralizing ceramic including an oxide and at least one of tourmaline and a radioactive substance in a predetermined ratio; a dispersing agent; a binding agent; and a solvent, which will be described later. The coating for anion generation 100 can be fabricated into a slurry state, a paste state, or a liquid state and can be applied to the outer surface of the cathode ray tube 11 or the inner and outer surfaces of the case 12. The coating for anion generation 100 can be fabricated by combining the main ingredients in various ratios considering the interference to the image of the display system 10 and the diameter of each particle.

In another preferred embodiment, charcoal can be used as material for generating anions and forming the coating for anion generation 100. The main ingredient of charcoal is carbon and a mineral component is included partially. For example, the ingredients of charcoal used as the anion generation material is preferably carbon of about 75%–85% and mineral of about 2%–3%. Carbon, which is a major ingredient of charcoal, has high electrical conductivity and emits negative ions. Negative ions emitted from charcoal can maintain freshness of objects around itself. Also, fine holes formed in the outer surface of charcoal function as a deodorant by exerting strong absorption force.

FIG. 2A shows the display system 20 according to the second preferred embodiment of the present invention. Referring to the drawing, the display system 20 consists of a cathode ray tube 21 and a case 22 in which the cathode ray tube 21 is installed. The cathode ray tube 21 includes a panel 23, and a funnel 24 which is coupled to the panel 23. An electron gun 25 is inserted into a neck portion 24*a* of the funnel 24. A deflection yoke 26 for deflecting an electron beam emitted from the electron gun 25 horizontally and vertically is installed at a cone portion 24*b*. In order to perform a capacitor function for stabilizing an anode (not shown) to which a high voltage is applied, an external graphite layer 27 is coated on the outer surface of the funnel 24, together with an internal graphite layer (not shown) coated on the inner surface of the funnel 24.

According to the characteristic feature of the present invention, the material for anion generation fabricated using $Al_2O_3$, $SiO_2$, ZrO, and $TiO_2$ as main ingredients is mixed with a corresponding base material for the cathode ray tube 21 or the case 22 when one is manufactured. For example, when the case 22 is manufactured, the material for anion generation is mixed with the base material for the case 22 in a desired ratio. FIG. 2B, shows the section of the funnel 24 and FIG. 2C shows the section of the case 22. Here, reference numeral 200 indicates a material for anion generation fabricated by mixing with a base material for the funnel 24, the external graphite layer 27, or the case 22. Also, the material for anion generation can be fabricated, for example, by mixing with a well-known surface material for charge prevention which coats a surface of the panel 23 in a predetermined ratio.

Thus, the display apparatus having the above material for anion generation can generate anions which are beneficial to humans. Also, the anions generated neutralize the cations accumulated on the surface of the panel 23 of the display apparatus so that electrostatic charge and accumulation of dust can be prevented.

Figure 3:
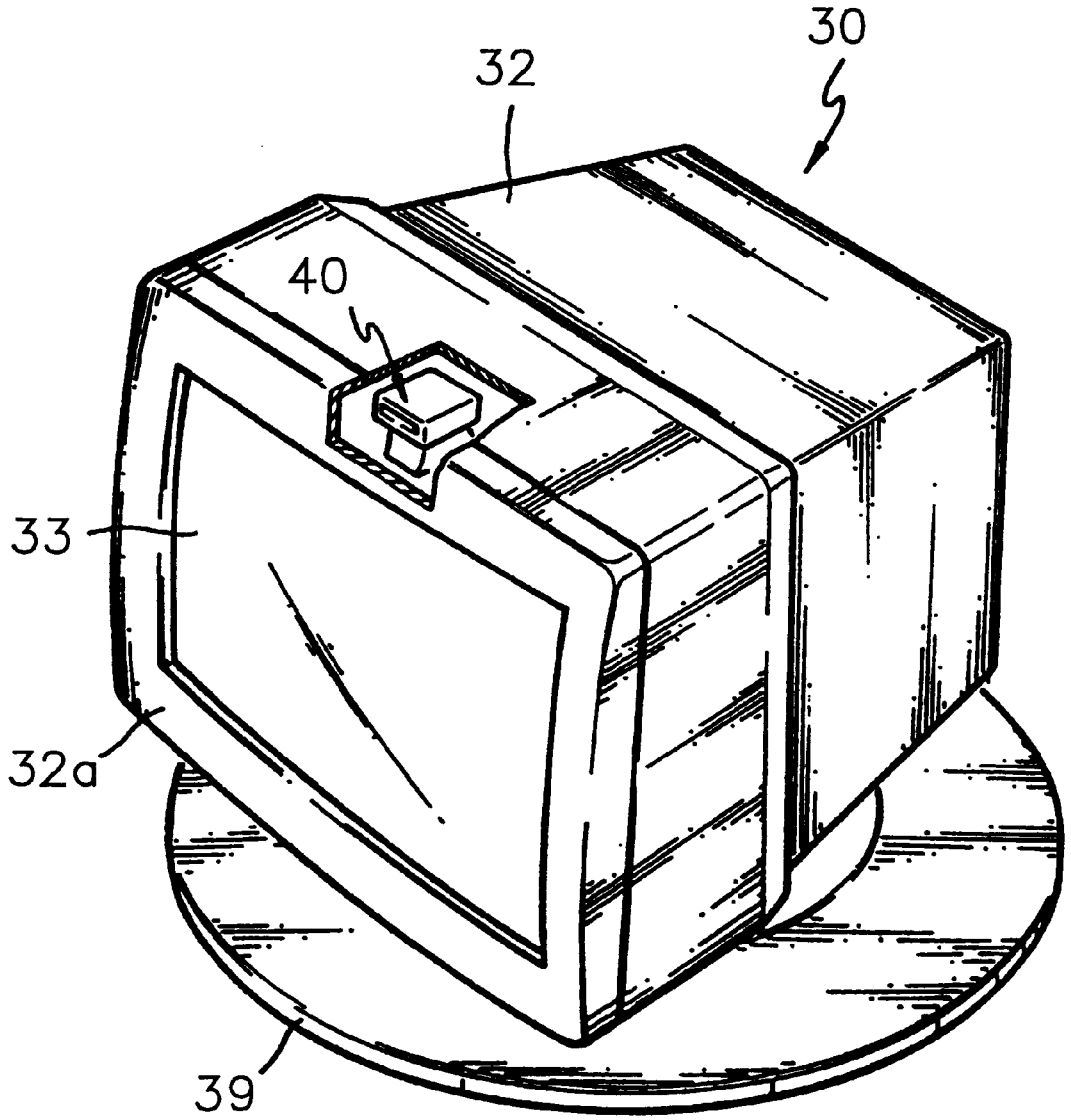
FIG. 3 is a partially-cut-away perspective view illustrating a display system according to a third preferred embodiment of the present invention.

FIG. 3 shows a display system having an anion generation apparatus according to the third preferred embodiment of the present invention.

As well known to the public, electrons or charged particles emitted perpendicular to the magnetic field receive a force in a direction perpendicular to the direction of the magnetic field according to Fleming's left-hand rule and thus move making a uniform circular motion. Also, when electrons are emitted at an angle of θ with respect to the direction of the magnetic field, only a kinetic component perpendicular to the magnetic field receives a force in a direction perpendicular to the magnetic field and the electrons perform a sort of spiral motion being combined with a horizontal component. The radius in the particle's circular motion is inversely proportional to the intensity of the magnetic field and proportional to the incident speed of the particle, which is referred to as Lorentz force. Consequently, the position and distance in transfer can be freely controlled by controlling the motion of the charged particle (ion) according to the incident speed of the particle and the intensity of the magnetic field. In the display system of FIG. 3, anions generated from the anion generation material can be transferred to a user without loss using Lorentz force.

Referring to FIG. 3, a cathode ray tube display system 30 is enclosed by a front case 32*a* and a rear case 32. The front case 32*a* and the rear case 32 are coupled together and a cathode ray tube (not shown) is installed inside the case. A panel 33 of the cathode ray tube is exposed to the front side of the display system 30 placed on a support 39. A receiving/transferring portion 40 of the anion generation apparatus is installed inside the case near the front case 32*a*. Considering that the receiving/transferring portion 40 should be fit for transfer of the anions transferred from the receiving/transferring portion 40 of the anion generation apparatus to a user watching the display system 30, the receiving/transferring portion 40 is preferably installed at the upper portion of the cathode ray tube at the upper middle portion of the front case 32*a*.

Figure 4:
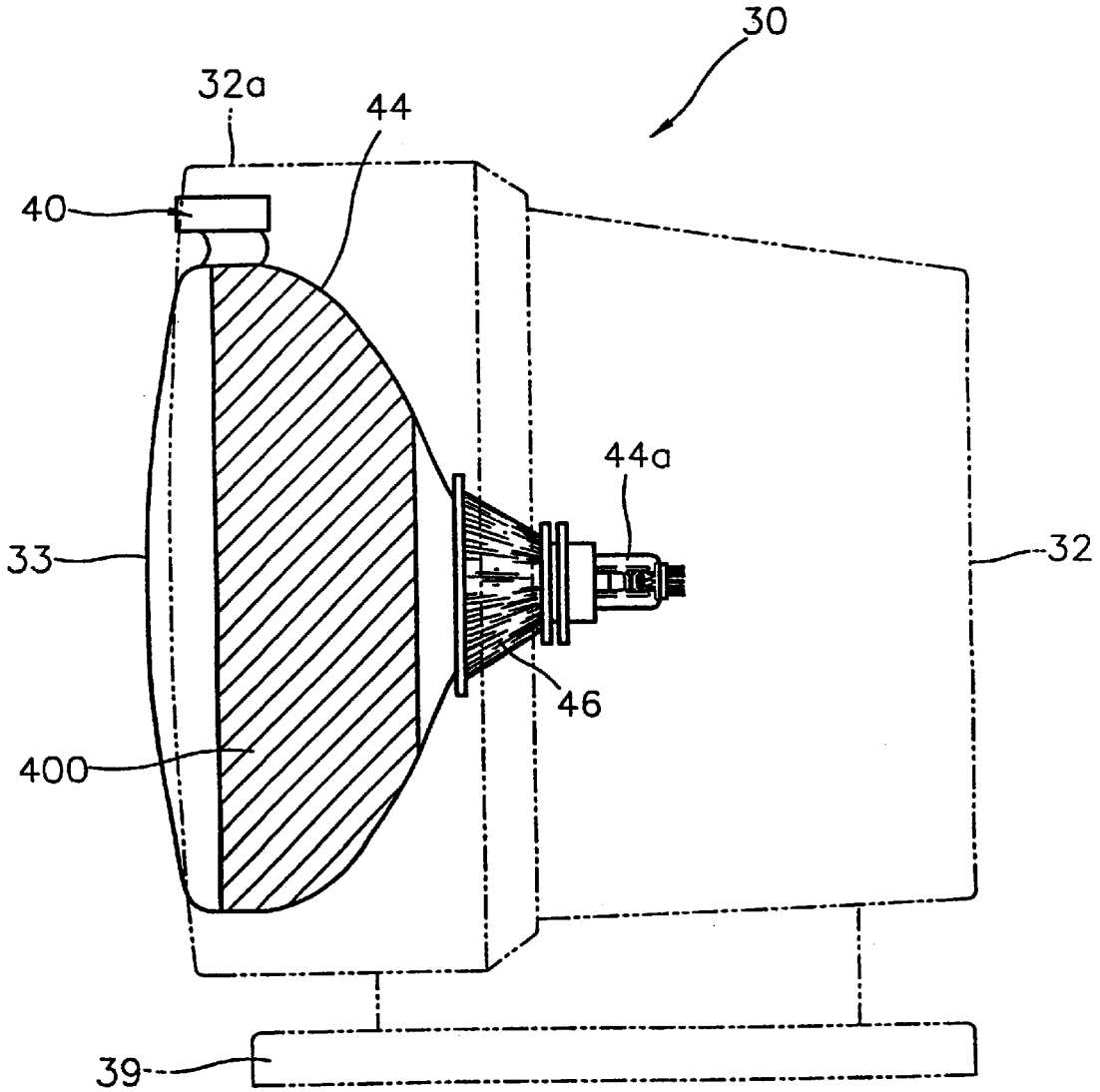
FIG. 4 is a side view showing the interior of the display system shown in FIG. 3.

FIG. 4 shows the display system shown in FIG. 3. Referring to the drawing, the cathode ray tube installed inside the case includes a panel 33 and a funnel 44 coupled to the panel 33 forming a seal and having a neck 44*a* which is integrally formed. A deflection yoke 46 is installed at the neck 44*a* of the funnel 44. A material for anion generation 400 coats the surface of the funnel 44. The material for anion generation 400, as mentioned in the above description with reference to FIG. 1, can coat the outer surfaces of the panel 33 and the funnel 44 or the inner/outer surface of the cases 32 and 32*a*. The anions generated from the material for anion generation 400 are emitted to the outside through the receiving/transferring portion 40. (When the display system is not in operation, anions are still generated.)

Figure 5:
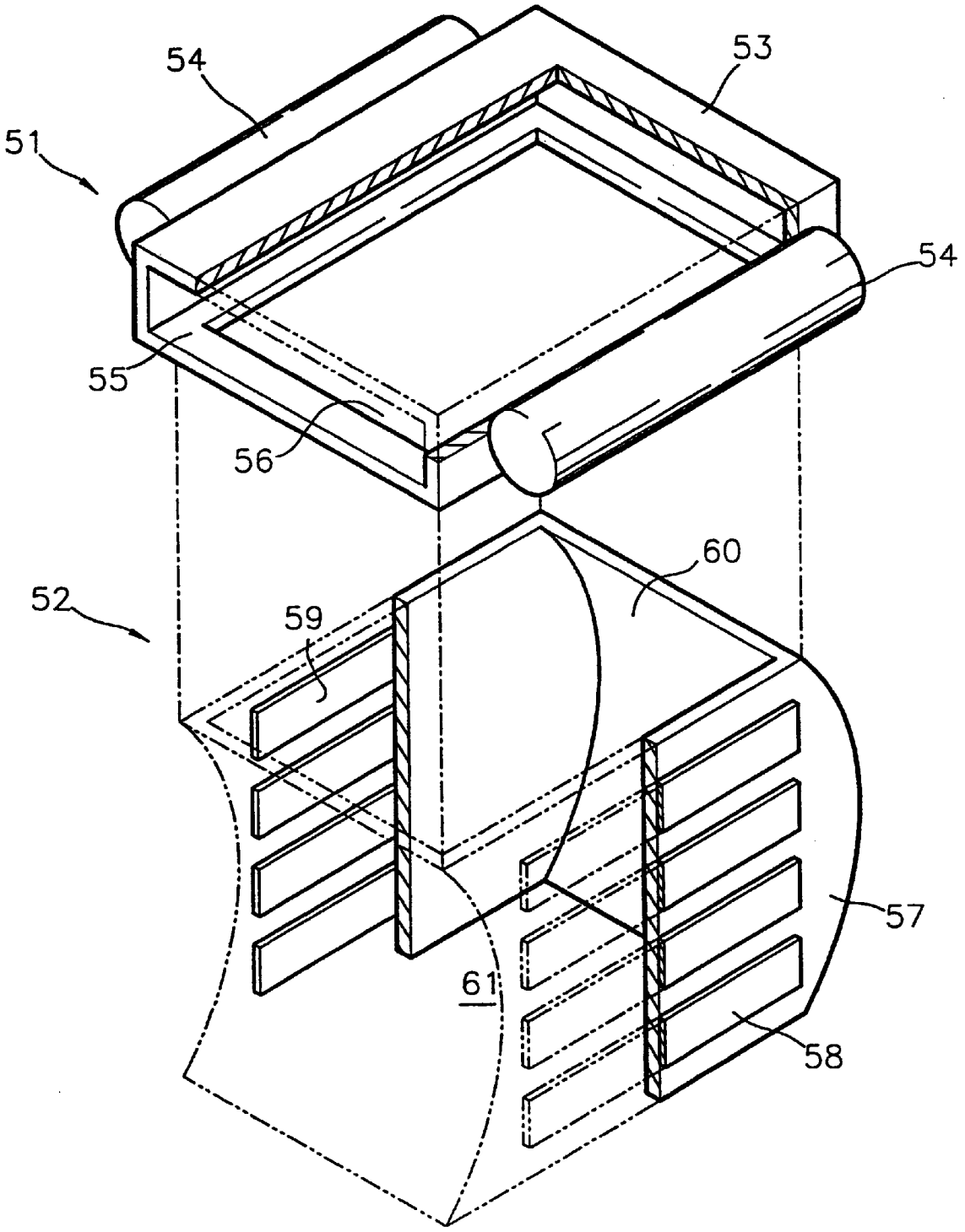
FIG. 5 is an exploded perspective view illustrating the transfer input portion of anions shown in FIGS. 3 and 4.

FIG. 5 shows the receiving/transferring portion 40 shown in FIGS. 3 and 4. Referring to the drawing, the receiving/transferring portion 40 is divided into an transferring portion 51 and a receiving portion 52. The lower surface of the receiving portion 52 is disposed at the upper portion of the funnel 44 of the cathode ray tube shown in FIG. 4.

The transferring portion 51 has a transfer case 53 and an electromagnet 54 installed at either side of the transfer case 53. The transfer case 53 is open to the front and lower sides and closed to the rear and left and right sides, as shown in the drawing. In the transfer case 53, anions are input through a lower side inlet 56 and emitted via a front side outlet 55. The front side outlet 55 is exposed to the outside of the front case 32*a* of the display system 30. A plurality of anion passing holes can be selectively formed at the lower surface of the transfer case 53.

The electromagnet 54 installed at the outer surfaces of the transfer case 53 generates a Lorentz, force so that the anions coming into the transfer case 53 can be emitted through the front side outlet 55. That is, according to Fleming's left-hand rule, a magnetic field is formed between the electromagnet 54 at both sides and anions are emitted through the lower side inlet 56, perpendicular to the magnetic field, so the force is applied to the anions in a direction toward the front side outlet 55. Thus, the anions coming inside the transfer case 53 can be transferred to the outside via the front side outlet 55. At this time, the anions having their route changed move in two types of motions. That is, the anions input perpendicularly to the magnetic field move in a simple circle motion and the anions input to the magnetic filed at an angle move in a spiral motion. By changing the current applied to the magnetic field, the intensity of magnetic field can be controlled so that the transfer distance of anions can be controlled.

To minimize the effect of the magnetic field an other portions of the display system, it is preferable that the electromagnet 54 installed at the transferring portion 51 forms a relatively very weak magnetic field. Accordingly, the radius in the motion of anion having its movement route changed by the Lorentz force becomes very great in inverse proportion to the intensity of magnetic field, assuming that the other conditions are not changed, so that the anions can be transferred to a user located relatively far from the display system 30.

A receiving case 57 of the receiving portion 52 is open to its upper and lower surfaces and has electromagnets 58 and 59 installed at both sides thereof. The receiving case 57 is installed close to the surface of the funnel 44, but does not contact the surface of the funnel 44. This is because all the anions generated in the case of the display system can pass through a lower side opening 61 of the receiving case 57. Preferably, the receiving case 57 is shaped as a bent tunnel having a predetermined curvature, as shown in FIG. 4. In FIG. 4, the anions generated from the anion generation material 400 are input to the lower side opening 61 of the receiving case 57 and move toward the lower side inlet 56 of the transfer case 53 via an upper side opening 60 of the receiving case 57.

A plurality of electromagnets 58 and 59 are installed respectively at both sides of the receiving case 57 aligned to each other. The electromagnets 58 and 59 installed at the receiving portion 52 generates a Lorentz force to induce anions to transfer them to the transfer case 53. The current applied to the electromagnets 58 and 59 is set to be different according to the position of the respective electromagnets 58 and 59 with respect to the receiving case 57. That is, the current is differently set such that the anions input through the lower side opening 61 can be moved by the Lorentz force toward the upper portion of the receiving case 57. At this time, the anions are moved along a predetermined trace.

The receiving portion 52 is selectively adopted in the anion generation apparatus. That is, the anion generation apparatus, without the receiving portion 52, can obtain effects expected by the present invention. Since the receiving portion 52 functions to input the anions to the transfer case 53, when the receiving portion 52 is not provided, the efficiency in inputting the anions to the transfer case will only be lowered.

The operation of the third preferred embodiment of present invention shown in FIGS. 3 through 5 will now be described.

The anions generated from the material for anion generation 400 of the display system 30 exist in a space formed between the cases 32 and 32*a* and the funnel 44. These anions are input through the lower side opening 61 of the receiving case 57. The anions input to the receiving case 57 are induced to move upward, being influenced by the Lorentz force generated by the electromagnets 58 and 59. The current applied to each of the electromagnets 58 and 59 is different according to the position thereof on the receiving case 57. Accordingly, anions can move upward along a predetermined path inside the receiving case 57. The anions are input to the inside of the transfer case 53 via the upper side opening 60 of the receiving case 57 and the lower side inlet 56 of the transfer case 53. A magnetic field is formed by the action of the electromagnet 54 in a horizontal direction inside the transfer case 53. Thus, the anions input receive a force toward the front side outlet 55. The anions emitted through the front side outlet 55 can reach a user. The distance of transfer of anions can be adjusted by controlling the current applied to the electromagnet 54.

In the display system 30 described with reference to FIGS. 3 through 5, the radius of motion of the anions varies according to the intensity of the magnetic field and the anions can be transferred to a user located at the position far from the display system 30. According to experimental results, when anions are emitted with a Lorentz force using only the electromagnet 54 provided in the transferring portion 51, without magnetic induction by the electromagnets 58 and 59, the amount of ions emitted increases 30% compared to a common monitor. The amount of ion emission was measured using an ion tester (model no. KST-900) manufactured by Kobe Dempa Co. The tester is separated about 50 cm from the display system. Also, the increase in ratio tends to increase as the distance of measurement increases.

When the amount of anions is measured at a distance of 50 cm from the display system while inputting anions through the receiving case 57, the amount of anions emitted increases by about 40–55%. Also, like the above case, the increase in ratio increases as the distance of measurement increases.

In the display system described with reference to FIGS. 3 through 5, a user can control the distance of anion emission according to the distance from the display system so that as many anions as possible can reach the user: Further, since the magnetic field can be regulated by controlling the amount of current applied to the electromagnet without complicated circuitry, manufacturing thereof is simplified.

Next, the material for anion generation 100, 200 and 400 respectively described referring to FIGS. 1, 2 and 4 will be described.

The material for anion generation 100, 200 and 400, as described above, is formed of a composition for anion generation including: a ceramic which includes at least one of tourmaline and a radioactive substance, and an oxide, and their mixing weight ratio varies between 0.0001:99.9999 and 50:50; a dispersing agent; a binding agent; and a solvent.

As the oxide for the material for anion generation, for example, an oxide which is at least one among oxides selected from the group consisting of silicon (Si), aluminum (Al), zirconium (Zr), lanthanum (La), magnesium (Mg), cesium (Cs), calcium (Ca), copper (Cu), zinc (Zn) and neodymium (Nd), or a composition thereof can be used. As the radioactive substance, any material exhibiting a feature of ionization may be used without limitation. Preferably, a naturally radioactive substance of thorium, uranium, neptunium, or actinium, synthetic radioactive substance, or a composition thereof are included. The tourmaline preferably exhibits a Mohs hardness of 7–7.5 and a specific gravity of 2.90–3.10 g/cm$^3$.

The average radius of particles of the oxide, the radioactive substance and the tourmaline is preferably about 0.01–100 $\mu$m. Since an excess of the above average particle radius may cause coating work of the anion generation material to be inconvenient or interfere in displaying an image, it is preferable to control the average particle radius within the above limits.

Also, it is preferable that the amount of ceramic included in the composition for anion generation be 1–50 weight % with respect to the total amount of the composition. Although ordinary materials for a solvent can be used for the above solvents without limitation, preferably, one or more organic solvent selected from the group consisting of alcohol, acetone, and N-metal-2-pyrrolidone can be used. Also, agents which are commonly used can be used as the dispersing agent and the binding agent without limitation and for some cases, by adding more detergent and endo plasmic reticulum, dispersion of the solvent and ease of coating can be further improved.

The material for anion generation is used for reducing or removing the amount of cations accumulated on a surface of an object by providing the oppositely charged anions thereto. Also, the charges externally provided to the surface of the object and accumulated thereon are neutralized by providing anions charged oppositely before the charges arrive at the object.

As a method for providing ions, a natural radioactive ray emitted from natural radioactive emission material and tourmaline having a permanent electrode are used. The $\alpha$, $\beta$, and $\gamma$ rays emitted from the natural radioactive emission material ionize atoms or molecules by their energy or generate ion pairs through ionization. In particular, the $\alpha$ ray dissociates electrons from gas particles in the air. Here, the gas particles in the air deprived of electrons are positively charged and the neighboring particles in the air are negatively charged due to the dissociated electrons. At this time, since molecular ions collide with each other at a speed of $10^9$ unit/sec, transfer of ions is easily made and the positive charges are transferred to a sort of particles having the lowest ionization potential and the negative charges are transferred to a sort of particles having the highest ionization potential, thus neutralizing the ionized air.

The tourmaline naturally forms an anode and cathode at opposite ends of its crystal and has a feature of emitting a far infrared ray of 4–14 $\mu$m wavelength. The tourmaline also generates anions by instant discharge in air.

The material for anion generation will be described in detail with preferred embodiments and comparative examples.

Preferred Embodiment 1

A composition for anion generation is manufactured by mixing 250 g, of a ceramic in which a composition of silica oxide, aluminum oxide, and zirconium oxide, thorium (Th), and uranium (U) were mixed in a weight ratio of 99.52:0.40:0.08, with 20 g of dispersing agent, 30 g of detergent agent, 100 g of epoxy-based binding agent, 30 g of endo plasmic reticulum, 40 g of ethanol, and 530 g of pure water.

Next, the composition for anion generation was coated on the surface of the funnel 14 of the cathode ray tube of a 15" monitor as shown in FIG. 1 to form a coated layer. The amount of ions generated was measured using a tester ("Ion Test 900") manufactured by Kobe Dempa Co. of Japan for the respective switch-on and switch-off cases. The results thereof are indicated in Table 1.

Comparative Example 1

This experiment is for comparison with respect to the preferred embodiment 1.

A 15" monitor, which is the same as the one used in the above preferred embodiment 1 but without a coating 100, was used. The amount of ions generated was measured using a tester ("Ion Test.900") manufactured by Kobe Dempa Co. of Japan for the respective switch-on and switch-off cases. The results -thereof are indicated in Table 1.

Preferred Embodiment 2

The composition for anion generation was coated on the outer surface of the funnel 14 of the cathode ray tube of a 15" monitor to form the coating 100.

Next, the degree of generation of static electricity when the switch is turned on was measured using a static decay meter (manufactured by Electro-tech Systems Inc.) and the results are indicated in Table 2. The static decay meter was installed at a position about 5 cm away from the side of the monitor. The maximum value of constant voltage at an instant when the switch is turned on was measured and the discharge time needed to discharge 63% of the maximum constant voltage was measured. From the above measured values, the amount of charges applied to a monitor case was calculated. The result thereof is indicated on Table 2.

Here, the measurement was performed at a temperature of 25±2° C. and a humidity of 55±5% and the measured amount of charges was proportional to the value obtained by multiplying the constant voltage by the discharge time.

Comparative Example 2

This experiment is for comparison with respect to the preferred embodiment 1.

A 15" monitor, which is the same as the one used in the above preferred embodiment 1 but without a coated layer 100 formed thereon, was used. The maximum value of constant voltage, the time needed to discharge 63% of the maximum constant voltage, and the amount of charges were measured under the same conditions as in the preferred embodiment 2. The results thereof are indicated in Table 2.

TABLE 1

| STATUS | AMOUNT OF ANIONS GENERATED (monitor in preferred embodiment 1/monitor in comparative example) | AMOUNT OF CATIONS GENERATED (monitor in preferred embodiment 1/monitor in comparative example) |
|---|---|---|
| Switch on | 5 | 0.2 |
| Switch off | 25 | 0.1 |

TABLE 2

| | MAXIMUM CONSTANT VOLTAGE (kV) | TIME NEEDED TO DISCHARGE 63% OF THE MAXIMUM CONSTANT VOLTAGE (minute) | AMOUNT OF CHARGES (%) |
|---|---|---|---|
| Comparative example 2 | 2.0 | 14.5 | 100 |
| Preferred embodiment 2 | 1.0 | 7.0 | 24 |

Referring to Table 1, in both states of the switch being on and off, it can be seen that the monitor having the coated layer 100 showed an increase in the amount of anions generated, compared to the common monitor. That is, the amount of anions sharply increased to neutralize cations accumulated on the outer surface of a panel, thus eliminating a charged state.

Also, referring to Table 2, the monitor having the coated layer 100 showed a lower maximum constant voltage and a shorter time needed to discharge 63% of the maximum constant voltage compared to the common monitor. Thus, the amount of charges is reduced to only 24% of the common monitor. That is, the generation of dust due to static electricity is reduced as much as the amount of charges being reduced.

What is claimed is:

1. A display system comprising:

a cathode ray tube having a panel and a funnel coupled to said panel, forming a seal, and having an external graphite layer on an outer surface;

a case in which said cathode ray tube is installed; and a material for anion generation disposed at a position with respect to said cathode ray tube or said case.

2. The display system as claimed in claim 1, wherein said material for anion generation is a coating on an outer surface of said panel or funnel of said cathode ray tube, or on an outer or inner surface of said case.

3. The display system as claimed in claim 1, wherein said material for anion generation is mixed with a base material of said external graphite.

4. The display system as claimed in claim 1, wherein said material for anion generation is mixed with a base material of said case when said case is manufactured.

5. The display system as claimed in claim 1, wherein said material for anion generation is mixed with surface material for preventing electrification of the surface material coating a surface of said panel.

6. The display system as claimed in claim 1, further comprising:

a transfer case having a lower side inlet through which the anions generated from said material for anion generation are input and a front side outlet through which the anions are emitted to the outside; and a first electromagnet installed on opposite sides of said transfer case to form a magnetic field inside said transfer case.

7. The display system as claimed in claim 6, wherein the voltage applied to said first electromagnet can be changed so as to change the intensity of the magnetic field formed inside said transfer case.

8. The display system as claimed in claim 6, further comprising:

a receiving case having an upper side opening corresponding to a bottom of said transfer case and a lower side opening corresponding to the outer surface of said funnel of said cathode ray tube; and a plurality of second electromagnets installed at opposite sides of said receiving case, parallel to each other.

9. The display system as claimed in claim 8, wherein the voltages applied to said second electromagnets are set to be different according to the installation position of each of said second electromagnets on said receiving case such that the anions passing through said receiving case can proceed toward said transfer case.

10. The display system as claimed in claim 1, wherein said material for anion generation includes: a ceramic which includes at least one of tourmaline and a radioactive substance, and an oxide, and their mixing weight ratio varies between 0.0001:99.9999 and 50:50; a dispersing agent; a binding agent; and a solvent.

11. The display system as claimed in claim 10, wherein the amount of said ceramic included is 1–50 weight % with respect to the total amount of said composition.

12. The display system as claimed in claim 10, wherein said oxide is at least one among oxides of a metal selected from the group consisting of silicon (Si), aluminum (Al), zirconium (Zr), lanthanum (La), magnesium (Mg), cesium (Cs), calcium (Ca), copper (Cu), zinc (Zn) and neodymium (Nd), or a combination thereof.

13. The display system as claimed in claim 10, wherein said radioactive emission substance is a naturally radioactive substance of selected from the group consisting of thorium, uranium, neptunium, and actinium, a synthetic radioactive substance, or a combination thereof.

14. The display system as claimed in claim 10, wherein said tourmaline exhibits a hardness of 7–7.5 on Mohs scale and has a specific gravity of 2.90–3.10 g/cm$^3$.

15. The display system as claimed in claim 2, wherein said material for anion generation is applied as a paste, liquid, or slurry.

16. The display system as claimed in claim 1, wherein said material for anion generation is charcoal.

17. The display system as claimed in claim 16, wherein said charcoal includes 75%–85% carbon and 2%–3% of a mineral.

* * * * *